United States Patent [19]

Kudlich et al.

[11] 4,114,534

[45] Sep. 19, 1978

[54] CONTROL SYSTEM FOR ROTARY PRINTING SCREENS

[75] Inventors: Hans Kudlich, Kufstein; Karl Schweitzer, Oberlangkampfen, both of, Austria

[73] Assignee: Maschinenfabrik Peter Zimmer Aktiengesellschaft, Kufstein, Austria

[21] Appl. No.: 730,139

[22] Filed: Oct. 6, 1976

[30] Foreign Application Priority Data

Oct. 6, 1975 [AU] Australia ..... 7646/75

[51] Int. Cl.[2] ..... B41F 15/10; B41F 13/38

[52] U.S. Cl. ..... 101/115; 101/118; 101/181; 101/182

[58] Field of Search ..... 101/115, 116, 118, 129, 101/248, 216, 181, 182; 74/710, 711

[56] References Cited

U.S. PATENT DOCUMENTS

| | | | |
|---|---|---|---|
| 3,774,534 | 11/1973 | Ichinose | 101/119 |
| 3,921,519 | 11/1975 | Zimmer | 101/116 |
| 3,926,111 | 12/1975 | Bohm | 101/116 |
| 3,934,505 | 1/1976 | Kushner | 101/129 |
| 3,998,156 | 12/1976 | Zimmer | 101/115 |

OTHER PUBLICATIONS

*Gears for Small Mechanisms*, by W. O. Davis, pp. 249–254; pub. 1970; N.A.G. Ltd., London.

*Primary Examiner*—Ronald E. Suter
*Attorney, Agent, or Firm*—Montague & Ross

[57] ABSTRACT

A printing machine with several groups of rotary-screen printing units, designed to print different color components of complementary portions of a recurrent pattern on an elongate web moving continuously beneath their screens, includes a programmer such as a perforated-type reader controlling the operation of the several printing units of each group in timed relationship dependent upon the web speed. A speed changer enables the peripheral velocity of the screens to be set at values different from the web speed, the timing of the printing operations being determined by two speed sensors upstream and downstream of the speed changer. These operations include a lowering of the rotating screen onto the web at the beginning of a printing cycle, a lifting of the screen off the web at the end of a working phase of that cycle, and a stoppage of screen rotation during part of the ensuing idling phase. The stoppage is caused by the release of a normally arrested output element of a differential gearing inserted between the speed changer and the drive shaft of each screen.

14 Claims, 7 Drawing Figures

CONTROL SYSTEM FOR ROTARY PRINTING SCREENS

FIELD OF THE INVENTION

Our present invention relates to a printing machine of the rotary-screen type in which two or more groups of cascaded printing units, each including a rotary screen, are provided for the purpose of producing complementary portions (e.g. halves) of a recurrent composite pattern on a continuously advancing substrate such as an elongate web, the units of each group serving to print different color components of the associated pattern section.

BACKGROUND OF THE INVENTION

A multistage printing machine of this character has been illustrated, for example, in U.S. Pat. No. 3,974,766. In that system the necessary correlation between the several printing units or stages is achieved with the aid of mechanical couplings interconnecting the drive shafts of their rotary screens so as to transmit a command from a control circuit down the cascade with the necessary delay depending upon the transport speed of the substrate and the angular positions of the pattern-forming sections of the several screens. The system also includes means for raising and lowering each screen with reference to the substrate, with the screen contacting the substrate only during a working phase of a printing cycle and being lifted off during an idling phase. In the latter phase a supplemental rotation is imparted to the screen for the purpose of returning it to its starting position before the beginning of the next cycle.

The system of U.S. Pat. No. 3,974,766 is particularly designed to imprint a substrate divided into relatively short sections which advance beneath the screens in a strictly synchronous manner, i.e, with their transport speed equaling the peripheral screen velocity. Such synchronism is not always desirable and should be avoided, for example, with certain pile fabrics having stiff upstanding tufts which may damage the screens unless a positive or negative speed differential causes their deflection onto the supporting fabric. Such a speed differential can also be used to modify the length of the printed pattern, e.g. for the purpose of compensating longitudinal shrinkages of the substrate.

Conventional mechanical transmissions interlinking the screens of such printing units are difficult to adjust for the purpose of allowing a selected slip to occur between the screens and the substrate. If the delay in the transmission of operating commands between successive printing units or stages is a function of transport speed, adjustments for a selected slip must also be made in the compensatory rotation imparted to each screen during its idling phase.

OBJECTS OF THE INVENTION

An important object of our present invention, therefore, is to provide simple and easily and dependably adjustable means for controlling the operation of a set of cascaded rotary-screen printing units, divided into two or more groups as discussed above, in a manner enabling the selection of different transport speeds for a given peripheral screen velocity or vice versa.

Another object is to provide means for insuring the return of a rotary screen to its starting position, during an idling phase of its printing cycle, independently of the transport speed of a substrate to be imprinted and with a mechanism considerably simpler than the geneva-motion drives conventionally employed for this purpose.

SUMMARY OF THE INVENTION

In accordance with a feature of our present invention, a shaft or other drive member of the rotary screen of each printing unit is linked with a transporter such as an endless conveyor, serving for the continuous advance of a substrate to be imprinted, by way of a transmission including an adjustable speed changer by which the ratio of the peripheral screen velocity to the substrate speed can be varied. The substrate speed is measured by a first sensor coupled with the transporter whereas the peripheral screen velocity is measured by a second sensor coupled with the speed changer. Each printing unit includes lifting means for raising its screen off the substrate at the end of a working phase and stop means for arresting the screen in the idling phase in a predetermined rotational position by effectively decoupling its drive member from the transmission, the lifting and stop means being controlled by operating signals generated by a programmer responsive to the output of the second sensor; these operating signals are distributed to the several printing units of each group, at intervals determined by the substrate speed, by timing means responsive to the output of the first sensor and connected to the programmer whereby these operating signals reach the lifting and stop means of all printing units following the first one in a predetermined sequence but with a delay determined by the substrate speed.

The programmer preferably comprises, for each group of printing units, a reader of signals stored in a recording medium such as a perforated for magnetic tape, for example. If changes in the pattern require a variation in the arc length of the perforated screen portion used for printing, the relative timing of the operating signals may be altered by substituting a different tape for the one previously employed. The readers for the several groups may coact with the same tape at staggered locations, or with respective tapes that are positively interconnected.

Advantageously, the timing means controlled by the first sensor includes a shift register, or a plurality of such shift registers in cascade, stepped by a pulse train generated by that sensor. A similar pulse train from the second sensor controls the advance of the recording medium or media of the programmer. The two sensors may in this case comprise respective disks on an input shaft and an output shaft of the speed changer, these disks co-operating with photodetectors illuminable through the disk notches.

According to another feature of our invention, the transmission linking the transporter with each drive member of a printing screen includes a differential gearing having one output element coupled with that drive member and another output element immobilizable by the stop means during a working phase of a printing cycle. The stop means advantageously includes in that case a detent mechanism engageable with peripheral formations of a rotary disk carried by the second output element.

BRIEF DESCRIPTION OF THE DRAWING

The above and other features of our invention will now be described in detail with reference to the accompanying drawing in which.

SPECIFIC DESCRIPTION

Figure 1:
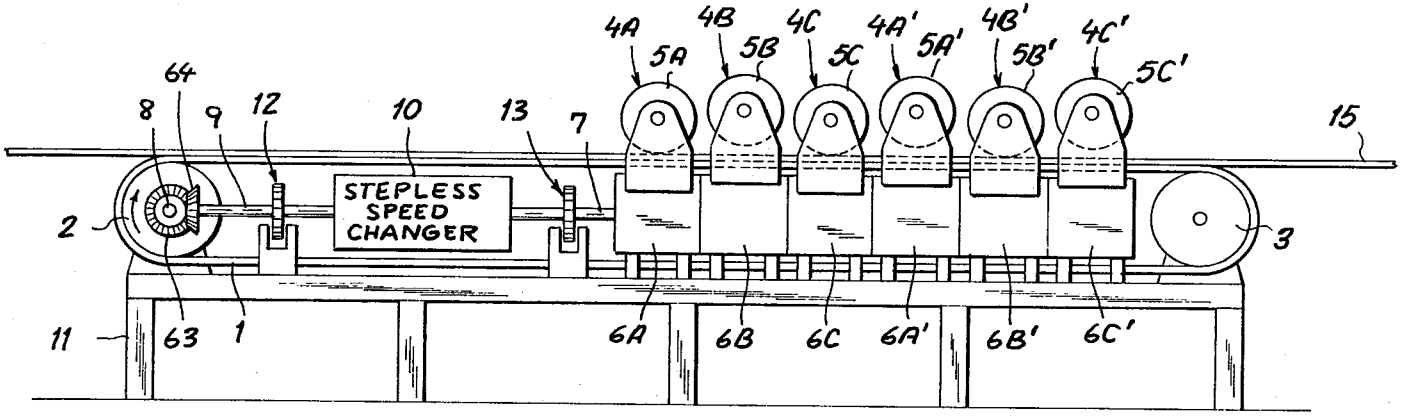
FIG. 1 is a side-elevational view of a multistage printing unit embodying the invention.

In FIG. 1 we have shown a printing machine which is generally similar to that disclosed in U.S. Pat. No. 3,974,766 but which is designed to imprint an elongate web 15 of textile material instead of a series of discontinuous web sections. This machine, accordingly, does not require any means for detecting an oncoming cloth edge as described in that patent.

The substrate 15 is transported by a continuously rotating conveyor belt 1 led around two rollers 2 and 3, roller 2 being driven from a nonillustrated motor coupled with its shaft 8. The roller shafts are journaled in bearings, not shown, atop a machine bed 11 carrying a multiplicity of printing units generally designated 4 in FIGS. 2 and 3, each unit comprising a printing screen 5 rotatable about a horizontal axis above the upper run of the conveyor. Each screen has a shaft 61 supported at opposite ends in bearings 62 of a tension frame 14 which is vertically movable, with reference to a stationary mounting 6, as indicated by an arrow A. In FIG. 1 the several printing units are shown divided into two groups, i.e. a first group 4A, 4B, 4C with screens 5A, 5B, 5C and mountings 6A, 6B, 6C and a second group 4A', 4B', 4C' with screens 5A', 5B', 5C' and mountings 6A', 6B', 6C'. It will be assumed that screens 5A, 5B, 5C of the first group serve to print different color components of one half of a recurrent pattern whereas screens 5A', 5B', 5C' of the second group print corresponding color components of the other half of that pattern.

Main shaft 8 is coupled via a pair of bevel gears 63, 64 with a transmission including an input shaft 9 of a stepless speed changer 10 and an output shaft 7 of that speed changer common to all the printing units. Speed changer 10 may be of the conventional frictional type with a frustoconical driving wheel contacted by a driven disk which rotates about an axis perpendicular to that of the wheel, complementary axial shifts of the wheel and the disk enabling their line of contact to be displaced to different radii of the frustoconical wheel surface. The two shafts 9 and 7 carry respective speed sensors upstream and downstream of speed changer 10, i.e. a first sensor 12 measuring the transport speed of web 15 (corresponding to that of conveyor belt 1) and a second sensor 13 measuring the peripheral velocity of each screen 5 which — during a working phase — is a predetermined function of the rotary speed of shaft 7. Sensors 12 and 13 are photoelectric pulse generators as more fully described hereinafter with reference to FIG. 5.

Figure 2:
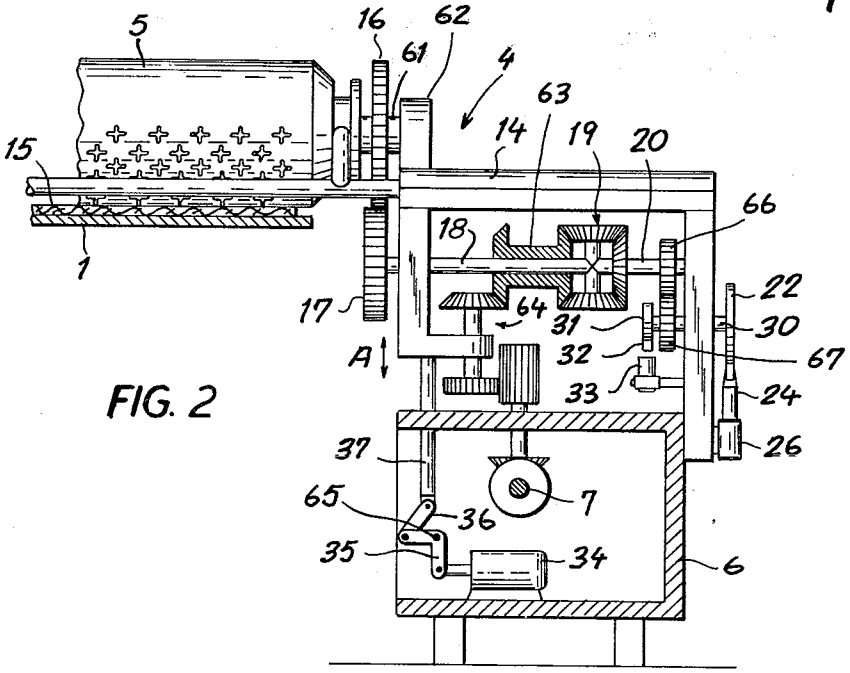
FIG. 2 is a fragmentary cross-sectional view of the machine of FIG. 1, drawn to a larger scale and showing details of a control mechanism for driving and lifting one of its printing screens.
Figure 3:
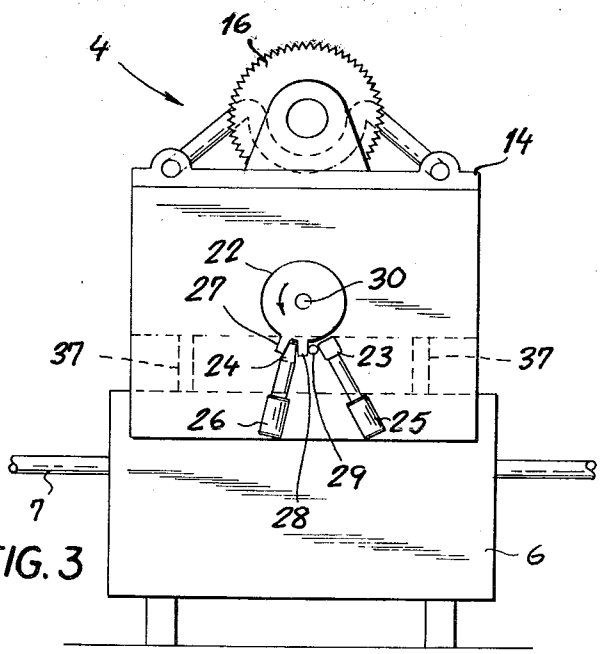
FIG. 3 is a side-elevational view of the assembly shown in FIG. 2.

Each screen shaft 61 carries a gear 16, FIGS. 2 and 3, in permanent mesh with a pinion 17 on a first output shaft 18 of a differential gearing 19 also having a second output shaft 20. Gearing 19, which could also be of the epicyclic or planetary type, has a hollow input shaft 63 coaxial with shaft 18, shaft 63 being coupled with transmission shaft 7 through a gear train 64 which remains engaged even during a raising or lowering of frame 14. The vertical frame movement is brought about by a pneumatic jack 34 in mounting 6 having a piston rod connected with a pair of bell-crank levers 35 (only one shown) with a fixed fulcrum 65; levers 35 are articulated, via links 36, to a pair of vertical rods 37 which support the elevatable frame 14 at points widely separated in the direction of conveyor motion, as seen in FIG. 3. In its lower position the screen 5 rests on the substrate 15 as seen in FIG. 2 and as illustrated in FIG. 1 for screens 5A, 5C and 5B'; in its upper position it is raised above the substrate as illustrated for screens 5B, 5A' and 5C'.

The second output shaft 20 of differential gearing 19 is connected through a pair of meshing gears 66, 67 with a shaft 30 which, like shafts 18 and 20, is journaled in frame 14. Shaft 30 carries a disk 22 forming part of a stopping mechanism by which the rotation of screen 5 can be arrested through the simple expedient of releasing a latch otherwise engaging the disk 22. A brake, not shown, may be actuated to engage the screen shaft 61 during such unlatching; this, however, will normally be unnecessary since the shafts 18, 61 positively coupled with the screen generally experience much more friction than the little-loaded shafts 20, 30 so that a release of these latter shafts will divert the entire torque of transmission shaft 7 to control disk 22 and screen 5 will be at standstill. When that disk is immobilized, gearing 19 will act as a positive coupling between shafts 7 and 18 whereby the screen will turn at a speed which is an invariable function of the setting of speed changer 10.

The selective immobilization of disk 22 is accomplished with the aid of detent means comprising a pair of fingers 23 and 24 positioned to engage in a wide gap and a narrow gap, respectively, defined on the disk periphery by a pair of teeth 27, 28 (FIG. 3). The fingers 23 and 24 are radially movable, with reference to shaft 30, by respective pneumatic jacks 25, 26 and are both retracted when the screen 5 is to be held stationary. At the beginning of a new printing cycle, jack 25 is actuated by an external operating signal — as more fully described hereinafter — to let the finger 25 drop into the wide gap extending over the major part of the disk periphery where it comes to rest against a resilient bumper 29 on the trailing edge of that gap defined by tooth 28. As the disk 22 slows down, jack 26 moves the finger 24 into the narrow gap now aligned with it in order to index the disk in an exact stop position determining the start of rotation of screen 5. Jack 26 is actuated by a pulse picked up by an electromagnetic coil 33, FIGS. 2 and 4, at the instant when a projection 32 of a ferromagnetic disk 31 on shaft 30 moves past just as the finger 23 engages the tooth 28 through its bumper 29. Finger 23 is shown to be so shaped as not to fit into the narrow gap between teeth 27, 28; this precaution, however, will not always be necessary.

The two-step latching operation described above enables the precise indexing of disk 22 in its stop position even if that disks rotates at high speed past the detent means 23 - 26. If desired, two or more pairs of closely spaced teeth could be disposed at equispaced locations on the disk periphery so as to define a plurality of narrow gaps establishing as many stop positions.

Let us consider, by way of example, the case of gear 16 and pinion 17 having 110 and 22 teeth, respectively, with gears 66 and 67 equal in size so that shaft 20 rotates at the same speed as shaft 20. In order to restart the screen in the same angular position at the beginning of each printing cycle, output shaft 18 of differential gearing 19 must make exactly five revolutions during the working phase and part of the idling phase of a cycle, corresponding to twice as many revolutions of input shaft 63. With disk 22 released during the remainder of a cycle and shaft 18 immobilized by the inherent friction of the screen support and/or by an ancillary brake, each disk revolution coincides with two revolutions of shaft 63. Thus, by letting the disk 22 perform one, two, three or four revolutions during the idling phase, we can extend the cycle from a minimum of 10 revolutions to 12, 14, 16 or 18 revolutions of shaft 63 corresponding to a proportional lengthening of the substrate section to be imprinted with the composite pattern. Screen 5, of course, prints only during half a cycle while making less than a full revolution, i.e. in the course of six, seven, eight or nine revolutions of shaft 63; shaft 18 will therefore make one or more additional half-turns after the screen has been lifted off the substrate at the beginning of the idling phase. Naturally, these values can be changed by altering the tooth ratios of gear trains 16,17 and/or 66,67 as well as by increasing the number of stop positions of disk 22.

Figure 4:
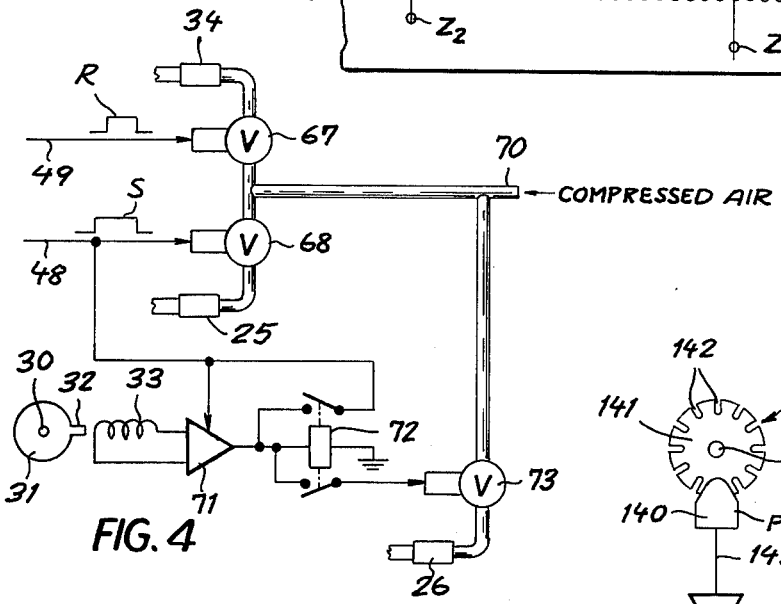
FIG. 4 is a circuit diagram for the electrical components of the mechanism shown in FIGS. 2 and 3.

In FIG. 4 we have illustrated a circuit for the actuation of lifting jack 34 and retaining jacks 25, 26 by respective operating signals R and S generated in a manner to be described. Signals S and R, in the form of rectangular voltage pulses, are fed via respective leads 48 and 49 to a pair of solenoid valves 67 and 68 controlling the admission of compressed air from a conduit 70 to jacks 25 and 34 for extending their spring-loaded piston rods. Signal S also activates an amplifier 71 receiving the pulse induced in coil 33 during each revolution of shaft 30 carrying the disks 22 and 31. In the presence of signal S, this pulse energizes a relay 72 which locks to lead 48 and causes operation of a further solenoid valve 73 to admit compressed air from conduit 70 to jack 26. The disappearance of signal S releases the relay 72, de-energizes the amplifier 71 to make further pulses from coil 33 ineffectual, and closes both valves 68 and 73 to deactivate the detent mechanism. If a brake were provided for insuring the halting of screen rotation, that brake would obviously be operated by the complement of signal S.

Figure 5:
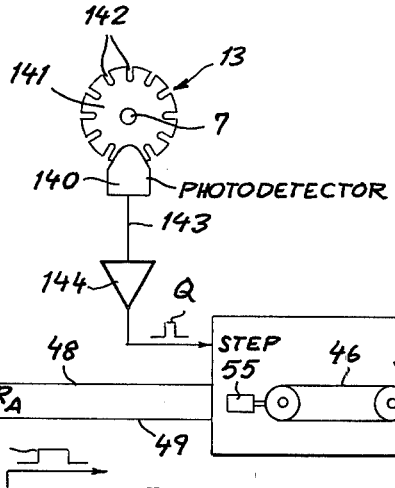
FIG. 5 is a diagrammatic representation of a programmer and a timer for the distribution of operating signals to the several printing stages of the machine.
Figure 5:
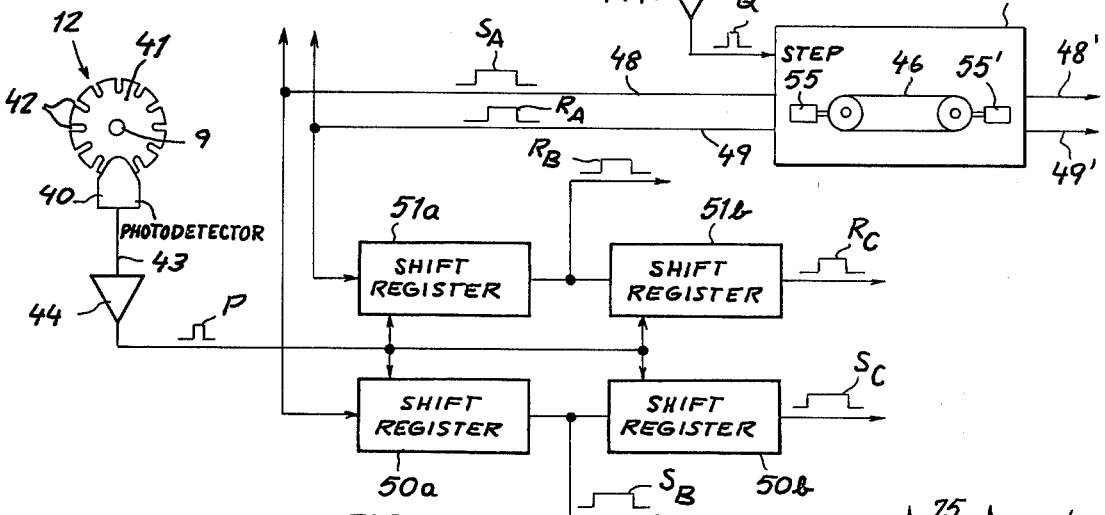

In FIG. 5 we have shown details of sensors 12 and 13. Sensor 12 comprises a notched disk 41 on shaft 9 whose peripheral notches 42 give passage to a beam of light trained by a nonillustrated source upon a photodetector 40 so as to generate a train of rectangular counting pulses P in the output of an amplifier and pulse shaper 44 connected to that photodetector via a lead 43. Sensor 13 comprises a similar disk 141 on shaft 7, its notches 142 serving for the illumination of a photodetector 140 which feeds an amplifier and pulse shaper 144 via a lead 143 to generate a train or rectangular counting pulses Q. Thus, the cadences of pulse trains P and Q are respectively proportional to the transport speed of web 15 and to the peripheral speed of screens 5 as measured at the input and at the output of speed changer 10.

Pulses Q are fed to a stepping input of a programmer 45 comprising two spaced-apart readers 55, 55' for an endless tape 46 on which the starting and stopping times of signals R and S are stored in a predetermined relative position. The programmer contains nonillustrated switches which are controlled by the perforation feelers of readers 55 and 55' to generate the raising signal R and the stop signal S for the first group of units 4A, 4B, 4C on leads 49 and 48 as well as corresponding signals for the second group of units 4A', 4B', 4C' on leads 49' and 48'. Leads 48 and 49 terminate at respective data inputs of two sets of cascaded shift registers **50*a*, 50*b* and 51*a*, 51*b*, having stepping inputs energized in parallel by pulses P from amplifier 43. The signals on these leads have been given the designations $S_A$ and $R_A$ since they are being fed directly to the control valves 68 and 69 (FIG. 4) of the first printing unit 4A. Delayed replicas $S_B$ and $R_B$, obtained at the outputs of shift registers 50*a* and 51*a*, are fed to corresponding valves of the second unit 4B whereas analogous signals $S_C$ and $R_C$ from the outputs of shift registers 50*b* and 51*b* are fed to their counterparts in the third unit 4C. In an analogous manner, the control valves of the other group of printing units 4A', 4B', 4C' are energized by the signals on leads 48' and 49' via nonillustrated shift registers, except that in that case the signals for all the units of the latter group are additionally delayed by further shift registers at the beginning of each cascade to account for the transit time of the substrate between screens 5A and 5A'**.

The number of stages in shift registers **50*a* and 51*a* equals the number of pulses P generated during passage of any point of web 15 from the nadir of screen 5A to that of screen 5B; the same applies, of course, to the stages of shift registers 50*b*, 51*b* and the transit time between screens 5B and 5C. If, for example, a pulse P comes into existence after every centimeter of web travel and if the distance between screens is 50 cm, then each of these shift registers will have 50 stages. The aforementioned further shift registers of the second group will then have 150 stages each, in accordance with the separation of screens 5A and 5A'** by 150 cm.

The relative positions of the control perforations on tape 46 will depend on the arc length of the apertured working portion of each screen and thus on the length of each web section (e.g. 2 meters) to be imprinted with the pattern. If the perforation code for a two-group system occurs only once on the tape, the two readers will be offset by half a tape length as shown.

Figure 6:
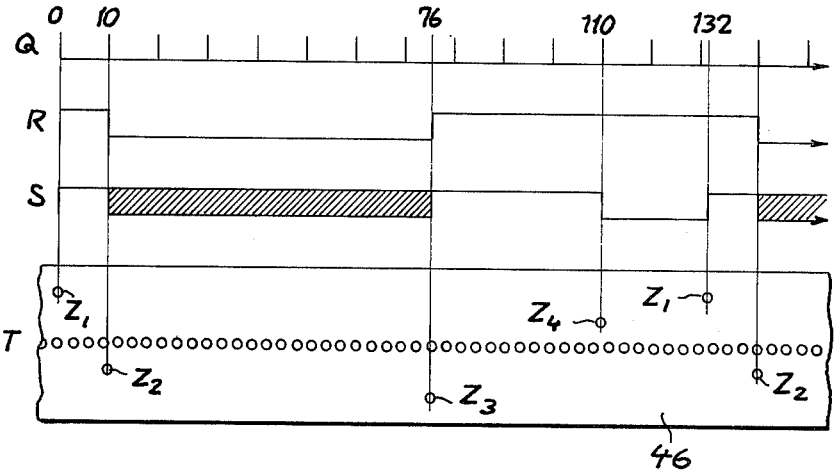
FIG. 6 is a set of graphs relating to the operation of the programmer and timer shown in FIG. 5.

In FIG. 6 this recurrent code has been illustrated for a tape 46, graph T, having a perforation $Z_1$ for starting the signal S at the beginning of a printing cycle, a perforation $Z_2$ for lowering the rotating screen onto the substrate by ending the signal R, a perforation $Z_3$ for restarting that signal to raise the screen, and a perforation $Z_4$ for terminating the rotation by ending the signal S prior to the end of a cycle. Printing occurs during half a cycle, in a working phase coinciding with the absence of signal R, as indicated by a hatched part of signal S. The top graph in FIG. 6 measures the arc length in terms of counting pulses Q, it being assumed that one such pulse is generated whenever transmission shaft 7 turns through an angle sufficient to advance the gear 16 by one tooth division in the blocked state of shaft 20. With 110 gear teeth as postulated above, screen 5 thus completes a revolution every 110 pulses. With signal S then interrupted for another 22 pulses to let the disk 22 make a full turn, the duration of a cycle amounts to 132 pulses Q. The working phase, therefore, lasts for 66 pulses.

Perforation $Z_1$ is detected by reader 55 at count 0. In the illustrated example, detection of perforation $Z_2$ occurs at count 10 to start the working phase which lasts until count 76 when perforation $Z_3$ passes under the reader. The screen is now lifted off the substrate but continues its rotation until count 110 (detection of perforation $Z_4$) when it comes to a halt after exactly one revolution. A cycle ends at count 132 when perforation $Z_1$ recurs. The idling phase extends from count 76 of one cycle to count 10 of the next cycle.

Especially with large slips, the relative offset of readers 55 and 55' may have to be somewhat adjusted to insure exact registration of the two pattern halves with adjoining parts of a web section to be imprinted.

Figure 7:
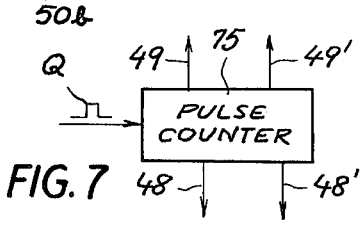
FIG. 7 diagrammatically illustrates an alternate programmer for the system of FIG. 5.

In FIG. 7 we have illustrated an alternate programmer comprising a binary pulse counter 75 with a counting capacity equaling the number of pulses Q generated throughout a printing cycle, e.g. 132 in the example given above. Counter 75 is stepped by these pulses Q to energize the leads 48, 49 and 48', 49' during certain parts of a cycle as discussed with reference to FIG. 6, these leads being connected to corresponding combinations of stage outputs of the counter via nonillustrated OR gates. Chains of cascaded counters stepped by pulses P, with the first counter of each chain periodically resettable by the output pulses of reader 55, could be used in lieu of the shift registers of FIG. 5 to delay the leading and trailing edges of signals S and R before closing and opening the switches which generate these signals for each printing unit of the associated group. The use of shift registers, however, allows greater flexibility inasmuch as with certain arrangements — e.g. with the units of the two groups interleaved rather than consecutively disposed — the transit time between units of the same group may be longer than a printing cycle so that two or possibly more signals may have to travel simultaneously through each shift register.

It will be apparent that our system can be readily adapted to different numbers of groups and to different numbers of printing units per group as well as to a wide range of pattern lengths. Its digital mode of operation insures great precision without requiring any synchronization between the web and screen speeds. Details of structure and circuitry can, of course, be modified without departing from the scope of our invention as defined in the appended claims.

We claim:

1. In a machine for printing a recurrent composite pattern on a substrate, comprising transport means for continuously advancing said substrate along a predetermined path and a set of cascaded printing units with rotary screens overlying said path, said set being divided into several groups for the printing of complementary portions of said pattern, each group including a plurality of printing units for the printing of different color components of the respective pattern portion, each printing unit being provided with a drive member for rotating the screen thereof at a peripheral velocity identical for all said printing units and with an elevatable mounting having lifting means for raising said screen off said substrate during an idling phase of a printing cycle following a working phase, the combination therewith of:

transmission means linking said transport means with each drive member for correlating the substrate speed with said peripheral velocity, said transmission means including a speed changer adjustable to vary the ratio of said peripheral velocity to said substrate speed, said speed changer having an input shaft coupled with said transport means and an output shaft operatively connected with the drive members of all said printing units;

stop means individual to each printing unit for deactivating the drive member thereof to arrest the respective screen in said idling phase in a predetermined rotational position;

a first pulse generator coupled with said input shaft for producing a first pulse train having a cadence proportional to said substrate speed;

a second pulse generator coupled with said output shaft for producing a second pulse train having a cadence proportional to said peripheral velocity;

programming means connected to said second pulse generator and including a recording medium stepped by said second pulse train for operating said lifting means and said stop means of each printing unit in a predetermined sequence defining a printing cycle by periodically reading out command signals stored on said recording medium; and timing means for distributing said command signals to the several printing units of each group at intervals determined by said substrate speed, said timing means including shift-register means provided with data inputs connected to said programming means for receiving said command signals therefrom and with stepping inputs connected to said first pulse generator for energization by said first pulse train, said shift-register means having different outputs respectively connected to all printing units following a first one of said printing units.

2. The combination defined in claim 1 wherein said pulse generators each include a notched disk on the respective shaft and a photodetector illuminable through the notches of the associated disk.

3. The combination defined in claim 1 wherein said shift-register means comprises a first shift register receiving a first signal commanding the actuation of said lifting means and a second shift register receiving a second signal commanding the actuation of said stop means.

4. The combination defined in claim 1 wherein said recording medium is an endless tape, said programming means further comprising a reader adjustably juxtaposed with said tape.

5. The combination defined in claim 1 wherein said transmission means includes a differential gearing for each printing unit having an input element coupled with said output shaft and a first output element coupled with said drive member, said differential gearing being further provided with a second output element, said stop means including retractable detent means for arresting said second output element during said working phase of a printing cycle.

6. The combination defined in claim 5 wherein said second output element comprises a rotary disk with peripheral formations engageable by said detent means.

7. The combination defined in claim 6 wherein said peripheral formations comprise at least two projections defining a wide gap and a narrow gap therebetween, said detent means including a first finger engageable in said wide gap and a second finger engageable in said narrow gap upon alignment therewith by abutment of said first finger with one of said projections defining an edge of said wide gap.

8. The combination defined in claim 7, wherein said one of said projections includes a resilient bumper engageable by said first finger for retarding the rotation of said disk, further comprising position-sensing means for advancing said second finger into engagement with said narrow gap upon detecting said alignment following retardation of disk rotation.

9. In a machine for printing a recurrent composite pattern on a substrate, comprising transport means for continuously advancing said substrate along a predetermined path and a set of cascaded printing units with rotary screens overlying said path, said set being divided into several groups for the printing of complementary portions of said pattern, each group including a plurality of printing units for the printing of different color components of the respective pattern portion, each printing unit being provided with a drive member for rotating the screen thereof and with an elevatable mounting having lifting means for raising said screen off said substrate during an idling phase of a printing cycle, the combination thereofwith:

common drive means coupled with said transport means for imparting rotation to the screens of all printing units;

a differential gearing for each printing unit having an input element coupled to said common drive means and a first output element coupled to said drive member, said differential gearing being further provided with a second output element;

retractable detent means individual to each printing unit for arresting said second output element during a working phase of a printing cycle; and timing means coupled with said transport means for generating staggered operating signals defining said printing cycle, said operating signals including first signals commanding the actuation of said lifting means at the end of said working phase and second signals commanding the retraction of said detent means in said idling phase.

10. The combination defined in claim 9 wherein said detent means comprises a first detent actuatable to establish an approximate stopping position and a second detent actuatable upon actuation of said first detent to establish an exact stopping position for said second output element.

11. In a machine for printing a recurrent composite pattern on a substrate, comprising transport means for continuously advancing said substrate along a predetermined path and a set of cascaded printing units with rotary screens overlying said path, said set being divided into several groups for the printing of complementary portions of said patterns, each group including a plurality of printing units for the printing of different color components of the respective pattern portion, each printing unit being provided with a drive member for rotating the screen thereof at a peripheral velocity identical for all said printing units and with an elevatable mounting having lifting means for raising said screen off said substrate during an idling phase of a printing cycle followed by a working phase, the combination therewith of:

transmission means linking said transport means with each drive member for correlating the substrate speed with said peripheral velocity, said transmission means including a speed changer adjustable to vary the ratio of said peripheral velocity to said substrate speed;

stop means individual to each printing unit for deactivating the drive member thereof from said transmission means to arrest the respective screen in said idling phase in a predetermined rotational position;

first sensing means coupling with said transport means for measuring said substrate speed;

second sensing means coupled with said speed changer for measuring said peripheral velocity;

programming means controlled by said second sensing means for generating operating signals for said lifting means and said stop means of each printing unit in a predetermined sequence defining a printing cycle; and timing means controlled by said first sensing means and connected to said programming means for distributing said operating signals to the several printing units of each group at intervals determined by said substrate speed;

said transmission means including a differential gearing for each printing unit having an input element coupled with said speed changer and a first output element coupled with said drive member, said differential gearing being further provided with a second output element, said stop means including retractable detent means for arresting said second output element during said working phase.

12. The combination defined in claim 11 wherein said second output element comprises a rotary disk with peripheral formations engageable by said detent means.

13. The combination defined in claim 12 wherein said peripheral formations comprise at least two projections defining a wide gap and a narrow gap therebetween, said detent means including a first finger engageable in said wide gap and a second finger engageable in said narrow gap upon alignment therewith by abutment of said first finger with one of said projections defining an edge of said wide gap.

14. The bombination defined in claim 13 wherein said one of said projections is provided with a resilient bumper engageable by said first finger for retarding the rotation of said disk, further comprising position-sensing means for advancing said second finger into engagement with said narrow gap upon detecting said alignment following retardation of disk rotation.

* * * * *

UNITED STATES PATENT AND TRADEMARK OFFICE

CERTIFICATE OF CORRECTION

PATENT NO. : 4,114,534

DATED : 19 September 1978

INVENTOR(S) : Hans Kudlich and Karl Schweitzer

It is certified that error appears in the above-identified patent and that said Letters Patent are hereby corrected as shown below:

In the heading of the Letters Patent, Column left, line number [30](Foreign Application Priority Data), for "Australia" read -- Austria --.

Signed and Sealed this

*First* Day of *May 1979*

[SEAL]

*Attest:*

RUTH C. MASON
*Attesting Officer*

DONALD W. BANNER
*Commissioner of Patents and Trademarks*